United States Patent [19]

Ricouard et al.

[11] Patent Number: 4,499,745

[45] Date of Patent: Feb. 19, 1985

[54] COMBINATION CYLINDER LOCK

[75] Inventors: Jacques Ricouard, Sancoins; Jean-Pierre Quillet, Charenton-du-Cher, both of France

[73] Assignee: L.A.S. Ricouard S.A., Courbevoie, France

[21] Appl. No.: 229,499

[22] Filed: Jan. 29, 1981

[30] Foreign Application Priority Data

Jan. 31, 1980 [FR] France ..... 80 02068

[51] Int. Cl.[3] ..... E05B 37/00

[52] U.S. Cl. ..... 70/285; 70/312; 70/316

[58] Field of Search ..... 70/285, 284, 312, 315, 70/316, 327, 328, 317, 318

[56] References Cited

U.S. PATENT DOCUMENTS

| | | | |
|---|---|---|---|
| 982,125 | 1/1911 | Chapman | 70/285 |
| 1,674,901 | 6/1928 | Ibarrart | 70/285 |
| 3,633,388 | 1/1972 | Atkinson | 70/80 |

*Primary Examiner*—Robert L. Wolfe

*Attorney, Agent, or Firm*—James Creighton Wray

[57] ABSTRACT

The invention relates to a lock for locking at least one movable element (1).

The lock according to the invention comprises a rocker (7) pivoting about a spindle and returned elastically towards a rest position in which it does not lock the said movable element (1), a cylinder (6) rotatable under the action of a key and controlling the said rocker (7) in the course of its rotation in order to bring it into a second position in which it locks the said movable element (1), the key being withdrawable from the cylinder (6) for a locking position and an unlocking position of the rocker (7), a plurality of rotating serrated wheels (3, 4) each co-operating with the said rocker (7) to bring it to the said second position with the exception of one angular position of each serrated wheel (3, 4) in which the latter does not co-operate with the rocker (7), a slide piece (22) co-operating with the serrated wheels (3, 4) and the cylinder (6) and being able to occupy a first position in which it locks neither the cylinder (6) nor the serrated wheels (3, 4), and a second position in which it locks the serrated wheels (3, 4) in rotation.

2 Claims, 6 Drawing Figures

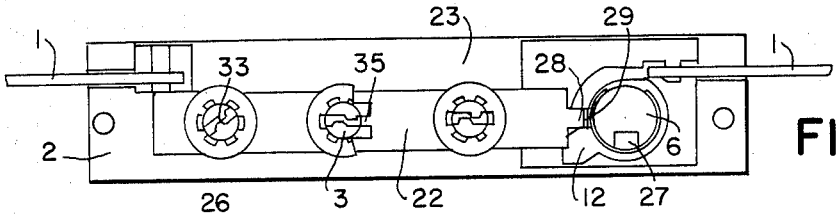
FIG. 1
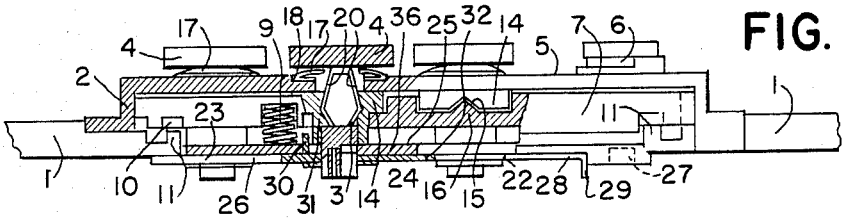
FIG. 2
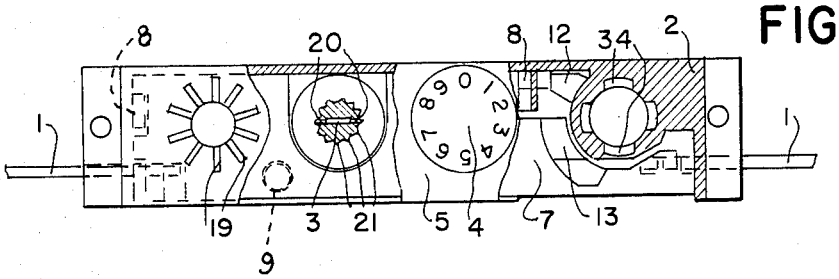
FIG. 3
FIG. 4
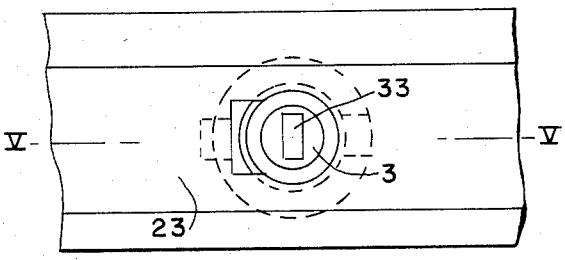
FIG. 5
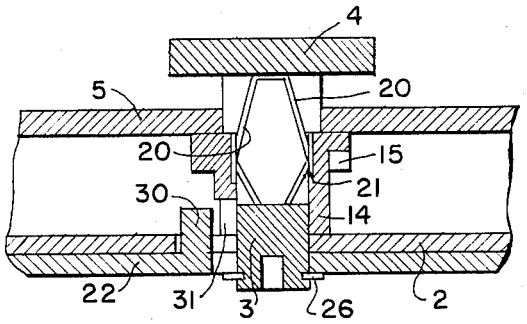
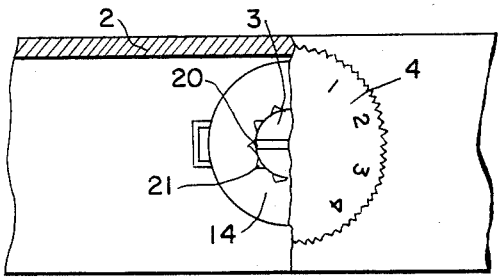
FIG. 6

COMBINATION CYLINDER LOCK

BACKGROUND TO THE INVENTION

The invention relates to a novel lock, the locking and unlocking of which can be controlled by a key cylinder or a set of serrated wheels forming a combination system, or by both at once.

OBJECT OF THE INVENTION

The novel lock, which is usable especially for luggage or furniture, permits the user to select the use of the lock with the key alone, with the combination system alone, or with both simultaneously. These different possibilities remedy the drawbacks of known locking systems which utilise only one of the two systems exclusively.

SUMMARY OF THE INVENTION

To this end the invention has for object a lock for locking at least one movable element, characterised in that it comprises a rocker pivoting about a spindle and returned elastically towards a rest position in which it does not lock the said movable element, a cylinder rotating under the action of a key and controlling the said rocker in the course of its rotation in order to bring it into a second position in which it locks the said movable element, the key beng withdrawable from the cylinder for a locking position and an unlocking position of the rocker, a plurality of rotating serrated wheels each co-operating with the said rocker to bring it to the said second position with the exception of one angular position of each wheel in which the wheel does not co-operate with the rocker, a slide piece co-operating with the wheels and the cylinder and capable of occupying a first position in which it locks neither the cylinder nor the wheels, and a second position in which it locks the wheels in rotation.

BRIEF DESCRIPTION OF THE DRAWINGS

The invention will be clearly understood on reading of the following description given with reference to the accompanying drawing, wherein:

FIG. 1 is a plan view, partially broken away, of a lock according to one example of embodiment of the invention, FIG. 2 is a view in lateral elevation, partially in section, of the lock according to FIG. 1, FIG. 3 is a plan view, partially broken away, of the lock according to FIGS. 1 and 2, FIG. 4 is a view from beneath, on a larger scale, of a serrated wheel of the lock according to FIGS. 1 to 3, FIG. 5 is a view in section along the line V—V in FIG. 4, and FIG. 6 is a plan view, partially in section, of the detail according to FIGS. 4 and 5.

DESCRIPTION OF PREFERRED EMBODIMENT

The lock as represented is intended to close a suitcase equipped with sliding rods 1 which are represented in the closed position. The lock comprises a substantially parallelepipedic casing 2 fixed to the suitcase (not shown) and receiving the ends of the rods 1 through openings in its two short faces. The casing 2 carries a series of three serrated wheels 3, the heads 4 of which protrude from the face 5 of the casing which is external to the suitcase. The spindles of the wheels 3 are aligned in a plane perpendicular to the face 5, parallel with the rods 1, the axis of a lock cylinder 6 likewise being aligned in this plane, while its head protrudes above the fact 5 of the casing.

The casing 2 contains a rocker 7 oscillating longitudinally about bearings 8 and returned into the position as represented by springs 9. In this position recesses 10, formed at the two extremities of the rocker 7 opposite to lugs 11 formd on the extremities of the rods 1, escape these lugs, so that the rods 1 can slide freely. This is the unlocked position of the lock, and sliding of the rods 1 permits of opening the suitcase.

Rocking of the rocker 7 into the locked position, against the action of the spring 9, is controlled by rotation of the cylinder 6 or of any one of the wheels 3. To this end the cylinder 6 carries a cam 12 co-operating with a ramp 13 of the rocker 7. Each serrated wheel 3 is fast in rotation with a counter-wheel 14 provided on its lower face with an eccentric recess 15 into which there can penetrate a point 16 of the rocker 7 when, by rotation of the serrated wheel 3, the recess 15 comes opposite to this point. For every other angular position of the wheel 3 the point 16 is expelled from the recess 15, so that the rocker 7 is rocked into the locking position.

Thus in the unlocking position as represented, the recesses 15 of the three counter-wheels 14 are each opposite to a respective point 16 and the angular position of the cylinder 6 is such that the cam 12 is away from the ramp 13. For every other position of one of the wheels 3 or of the cylinder 6 the rocker 7 is in the locking position.

The head 4 of each wheel 3 carries code indications constituted (in the example as described) by the numerals 0 to 9, the number from 0 to 999 indicated by the position of the three wheels forming the combination, and only one combination corresponding to unlocking. The indexing of each of the serrated wheels 3 to each of the positions corresponding to a numeral is ensured by an elastic washer 17 provided with peripheral points 18 co-operating with radial grooves 19 formed in the face 5 of the casing 1.

The connection in rotation between each serrated wheel 3 and its counter-wheel 14 is effected by a spring 20 fast with the serrated wheel and comprising two arms constantly pressing each in a recess 21 of the counter-wheel 14. The serrated wheel could comprise points formed in an elastic part of the wheel. The force of the spring 20 is such that the connection in rotation exists when it is necessary to overcome the indexing effected by the elastic washer 17.

The lock comprises a slide piece 22 guided longitudinally against the face 23 of the casing 1 opposite to the face 5, that is to say the slide piece is accessible only from the interior of the suitcase, which thus must be open, which presumes that the user is acquainted with the code and possesses the key. The slide piece 22 can occupy a middle position (in which it is represented) in which it is retained by a detent 24, co-operating with a recess 25 formed in the casing 2. The slide piece 22 is pressed elastically on the face 23 of the casing by elastic stop pieces 26.

The lock cylinder comprises, at its extremity opposite to the head 6 a radial groove 27 which is aligned with the slide piece 22 when the cylinder is in one position. If in this position the slide piece 22 is displaced to the right (in the drawing), its extremity 28 comes to lodge in the groove 27. The extremity 28 comprises a bentover finger 29 serving to actuate the slide piece 22.

The slide piece 22 further comprises tabs 30 which, in this position, come to lodge each in a radial recess 31 formed in each of the counter-wheels 14, provided that the wheel has previously been brought into its unlocking position in which the recess 31 is opposite to the tab 30. In this extreme position of the slide piece 22 the latter is retained by co-operation of its detent 24 with a recess 32 and the counter-wheels 14 are locked in rotation. The extremity of each serrated wheel 3 opposite to the head 4 comprises an axial slot 33 advantageously having the profile of the key of the cylinder. Thus by introducing the key into the slot 33, it is possible to rotate the serrated wheel 3, the counter-wheel 14 remaining fast by virtue of the elastic deformation of the spring 20, the arms of which come to lodge successively, for each graduation notch, at the bottoms of other recesses 21 of the counter-wheel 14 which is held fast.

Thus after having opened the suitcae, having set the cylinder in the closure position and having set the wheels in the unlocking position, the user can push back the slide piece 22 to the position locking the cylinder as just described. Then having withdrawn the key from the cylinder he can by means of this key successively modify the position of each serrated wheel 3 in relation to its counter-wheel 14, that is to say modify the unlocking combination. By return of the slide piece 22 to its middle position the serrated wheels 3 and the cylinder are liberated and the lock can be utilised afresh with the key and the serrated wheels at the same time, the serrated wheels having to show the new combination to permit opening.

If it is desired to use only the serrated wheels 3, it is sufficient to rotate the cylinder into the unlocking position (represented in the drawing) and withdraw the key. The cylinder is then immobilised by the penetration of its pins into recesses 34 of the casing 2, which prevents all action of the cam 12 upon the ramp 13 and thus all locking of the lock by the cam 12.

If it is desired to utilise only the cylinder to control the lock, the serrated wheels 3 must be immobilised in the unlocking position. To this end the slide piece 22 comprises dogs 35 which are respectively opposite slots 33 of the serrated wheels 3. If in the unlocking position of the wheels 3, the suitcase being open, the user pushes back the slide piece 22 to the left (in the drawing), the dogs 35 each penetrate into a slot 33 so that the wheels 3 are immobilised. The lock can then be controlled by the cylinder alone. In this position the slide piece 22 is held by co-operation of its detent 24 with a third recess 36 of the casing 2.

When the lock utilises the serrated wheels 3 and the cylinder at the same time, it is important that the rocking of the rocker 7 caused by the cam 12 should be such that the points 16 are no longer in contact with the lower faces of the counter-wheels.

We claim:

1. A lock comprising:

(a) an elongate casing (2) having an outer surface (5) which is outermost when in use and having an inner surface (23) which is inside the container when in use, (b) at least one locking member (1) movably connected with the casing, (c) a rocker (7) movably mounted in the casing on an axis disposed parallel to the length of the casing, said rocker being engageable (11) with said locking member (1) to lock it when required, (d) first elastic means (9) for moving the rocker on its axis in one direction which is for locking, (e) a key-operable lock cylinder (6) mounted rotatably on the casing, (f) a plurality of wheels (3) mounted rotatably in the casing, said wheels having finger engageable means (4) on their outer ends, said wheels having their axes parallel to each other and in a plane that is parallel to the length of the casing and which also contains the axis of said lock cylinder, (g) projections (16) on the rocker so arranged that when the wheels are rotated to their unlocking positions said elastic means (9) moves the rocker to engage the projections in recesses (15), (h) a slide (22) slidably mounted against said inner surface (23), said slide being engageable with the cylinder (6,27) and with said wheels (3,33,35) to lock the cylinder and wheels against rotation, (i) counter-wheels (14) mounted one on each of said wheels (3), (j) recesses (15) within the casing, one by each of said counter-wheels, (k) second elastic means (20) holding each counter-wheel (14) to its wheel (3) in a rotatably adjustable manner, (l) projection means (30) on said slide engageable with said counter-wheels to hold them, when required, against rotation, and (m) cam means (12,13) on the cylinder (6) and rocker (7) whereby rotation of the cylinder can rock the rocker to its position where it locks (11) the movable member (1) and disengages from the wheels (3).

2. A lock as claimed in clam 1 wherein said second elastic means (20) is in the form of a spring having two arms cooperating with grooves (19) in the counter-wheel.

* * * * *